US005461959A

United States Patent [19]

Sassmannshausen et al.

[11] Patent Number: 5,461,959

[45] Date of Patent: Oct. 31, 1995

[54] MEMBRANOPHONE AND DAMPING MEMBER FOR A MEMBRANOPHONE

[75] Inventors: Werner Sassmannshausen, Bad Berleburg-Wingeshausen; Karl-Heinz Menzel, Bad Berleburg-Aue; Werner Sassmannshausen, Bad Berleburg-Berghausen; Stefan Schreiber, Köln; Anke Kleindienst, Bad Berleburg; Hubert Günther, Köln, all of Germany

[73] Assignee: SONOR Johs. Link GmbH, Bad Berleburg, Germany

[21] Appl. No.: 185,659

[22] Filed: Jan. 24, 1994

[30] Foreign Application Priority Data

Jan. 27, 1993 [DE] Germany ..... 43 02 134.4

[51] Int. Cl.[6] ..... G10D 13/02

[52] U.S. Cl. ..... 84/421

[58] Field of Search ..... 84/411 R, 413, 84/421

[56] References Cited

U.S. PATENT DOCUMENTS 4,060,019 11/1977 Sleishman ..... 84/413

4,334,458 6/1982 Grauso ..... 84/411 R 4,903,570 2/1990 Sassmannshausen et al. ..... 84/421

*Primary Examiner*—Michael L. Gellner

*Assistant Examiner*—Patrick J. Stanzione

*Attorney, Agent, or Firm*—Friedrich Kueffner

[57] ABSTRACT

A membranophone includes a principal skin or head skin and a secondary skin as well as a skin tightening device and/or tuning device. The skin tightening and/or tuning device includes rod-shaped tightening elements at least for the head skin, wherein the tightening elements are arranged uniformly distributed over the outer circumference of the resonator shell of the membranophone, and wherein the tightening elements are supported by support members fastened to the resonator shell, on the one hand, and the tightening elements adjustably act through threaded members on the tightening hoop for the skin or skins, on the other hand. Damping members are arranged between the support members and the resonator shell or kettle. The skin or skins are held by winding hoops and can be tightened and, thus, tuned by means of the winding hoops and the tightening hoops relative to the opening rim of the resonator shell. The membranophone further includes at least one holding stirrup which is connected to the resonator shell through a damping member.

14 Claims, 5 Drawing Sheets

MEMBRANOPHONE AND DAMPING MEMBER FOR A MEMBRANOPHONE

BACKGROUND OF THE INVENTION

1. Field of the Invention

The present invention relates to a membranophone, such as, a snare drum, a tom-tom drum or bass drum of drum sets. The membranophone includes a principal skin or head skin and a secondary skin as well as a skin tightening device and/or tuning device. The skin tightening and/or tuning device includes rod-shaped tightening elements at least for the head skin, wherein the tightening elements are arranged uniformly distributed over the outer circumference of the resonator shell of the membranophone, and wherein the tightening elements are supported by support members fastened to the resonator shell, on the one hand, and the tightening elements adjustably act through threaded members on the tightening hoop for the skin or skins, on the other hand. Damping members are arranged between the support members and the resonator shell or kettle. The skin or skins are held by winding hoops and can be tightened and, thus, tuned by means of the winding hoops and the tightening hoops relative to the opening rim of the resonator shell. The membranophone further includes at least one holding stirrup which is connected to the resonator shell in a dampened manner.

2. Description of the Related Art

U.S. Pat. No. 4,158,980 discloses a membranophone of the above-described type in the form of a tom-tom drum. However, in this known drum, only the head skin is connected through tightening screws to the resonator shell. The secondary skin is not connected to the resonator shell. The support stirrup adapted to the cylindrical contour of the tom-tom drum surrounds the resonator shell over at least 180° degrees. The support stirrup is connected through elastic intermediate members by means of four tightening screws. The elastic intermediate members are arranged below lug-like projections of the tightening screw connectors which essentially form a tightening hoop. The projections rest under the influence of the weight of the resonator shell on flanges of the stirrup which are bent out at a right angle. Consequently, a disadvantageous influence on the tension of the head skin and/or the projections serving as tightening hoop cannot be avoided. The tom-tom drum can be fastened, for example, to a bass drum by means of a clamping device which is part of a support plate which, in turn, projects downwardly in a cantilevering manner from the support stirrup and parallel to the resonator shell.

German Utility Model 88 10 545.8 discloses a membranophone with threaded members acting on tightening hoops for the skins for adjusting the head skin as well as the secondary skin, wherein the skins are held by winding hoops and wherein the skins can be tightened relative to the opening rim of the resonator shell by means of the winding hoop and by means of the tightening hoops. This known membranophone does not include a support stirrup. The support members required for tightening the skins engage with a neck in a bore of the resonator shell and are fixed and tightened in the bore by means of a head screw, wherein resilient damping members are arranged between the support members and the bores. The head screw extends through the damping member, for example, in the form of a flat disk of rubber, and interacts with an internal thread which is worked coaxially into the neck and into the head piece of each support member. The head screws make it possible to fasten the support members to the resonator shell in a secure but to some extent elastically resilient manner.

SUMMARY OF THE INVENTION

Therefore, it is the primary object of the present invention to provide an improved damping action of the vibration delivery in a simple manner in a membranophone of the above-described type.

In accordance with the present invention, the support stirrup is fastened by means of damping members inserted into the resonator shell.

Since, as a result of the configuration according to the present invention, the damping members are not only arranged between the support members and the resonator shell but also between the support stirrups and the resonator shell, the desired optimized damping action can be achieved. Preferably, a damping member each can be clipped onto one of the ends of the holding stirrups.

In accordance with a preferred further development of the invention, the damping members are placed over the support members. In this case, instead of fastening the holding stirrup with the damping member directly on the kettle, the holding stirrup can be mounted indirectly through the support members, wherein two adjacent support members are provided with damping members placed over the support members. Thus, each damping member simultaneously dampens two structural components.

Particularly in membranophones with tightening devices for the head skin as well as for the secondary skin, it is recommended to provide two holding stirrups arranged spaced apart and one above the other. In this case, the holding stirrups which serve for fastening, for example, a tom-tom drum to a base drum or for fastening a suspended tom-tom drum to a large drum or base drum, the holding stirrups can then have an angle of surrounding the resonator shell which is substantially smaller than 180°, for example, only 90°, without impairing the stability of the fastening of the holding stirrups.

In accordance with another advantageous feature, the two holding stirrups are connected to each other through a lug which may extend at a right angle to the holding stirrup. As a result, the lug makes it possible to fasten the tom-tom drum to the base drum, on the one hand, and, on the other hand, the lug substantially increases the stiffness of the holding stirrup mounted on the resonator shell. Instead of mounting a tom-tom drum on a bass drum, it is also possible to use the support stirrup or stirrups for mounting the legs of stands, for example, for a bass drum or a standing tom-tom drum.

It is recommended to provide the lug with a vertically adjustable fastening member. In accordance with a proposal of the invention, the lug may be of telescoping construction. Alternatively, a guide shoe which can be displaced with the fastening member can be arranged on the lug. As a result, it is possible, for example, to change the mounting height of a suspended tom-tom drum.

In accordance with another further development of the present invention, the lug is fastened at least at the lower support stirrup through a damping member. This makes it possible to prevent any mechanical vibration transmission from one instrument to another, wherein, if necessary, the damping characteristic of the damping member may be infinitely adjustable.

In accordance with another feature, the fastening member is provided with a clamping piece constructed as a rotary joint. Consequently, one or even several suspended tom-tom drums can be placed in the clamping member at the lug connecting the two holding stirrups, for example, of a bass drum, and because the joints are rotary, the inclinations of the tom-tom drums relative to the bass drum is adjustable.

A damping member inserted for the holding stirrup and/or the lugs may preferably be composed of a disk having a through bore, a circumferential groove and a central pin. It is then only necessary to lock the circumferential groove in corresponding cylindrical recesses of the holding stirrup or to clip the circumferential groove from the inside on corresponding ring-like ends of the holding stirrup. For this purpose, the damping member advantageously is composed of a soft, elastic material, preferably rubber. A holding stirrup provided in this manner with damping members is then inserted with the pin of the damping member in bores of the resonator shell and is fastened to the resonator shell by means of screws inserted into the through bores.

By providing the surface of the disk of the damping member facing away from the pin with a recess, the damping member or damping members of the holding stirrups can be placed on adjacent support members. This requires that the dimensions of the recess corresponds to the dimensions of the support member. As a result, it is possible to achieve a simultaneous damping of the holding stirrups and the support members in a simple manner by the structural configuration or shape of the damping member.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described a preferred embodiment of the invention.

BRIEF DESCRIPTION OF TEE DRAWING

DETAILED DESCRIPTION OF THE PREFERRED EMBODIMENTS

Figure 1:
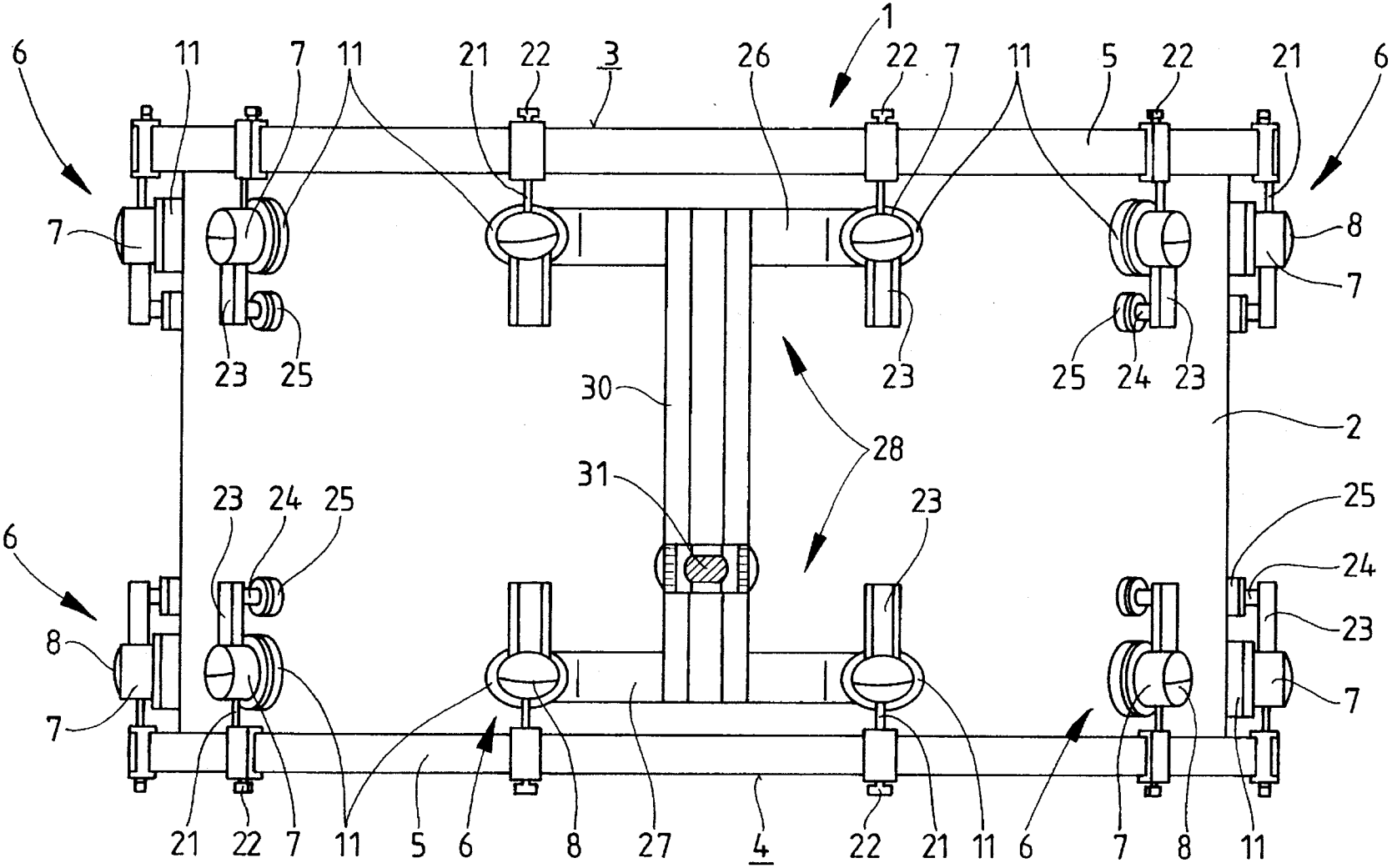
FIG. 1 is a side elevational view of a membranophone in the form of a bass drum with a skin tightening and/or tuning device and with a tom-tom drum support dampened in accordance with the present invention.
Figure 2:
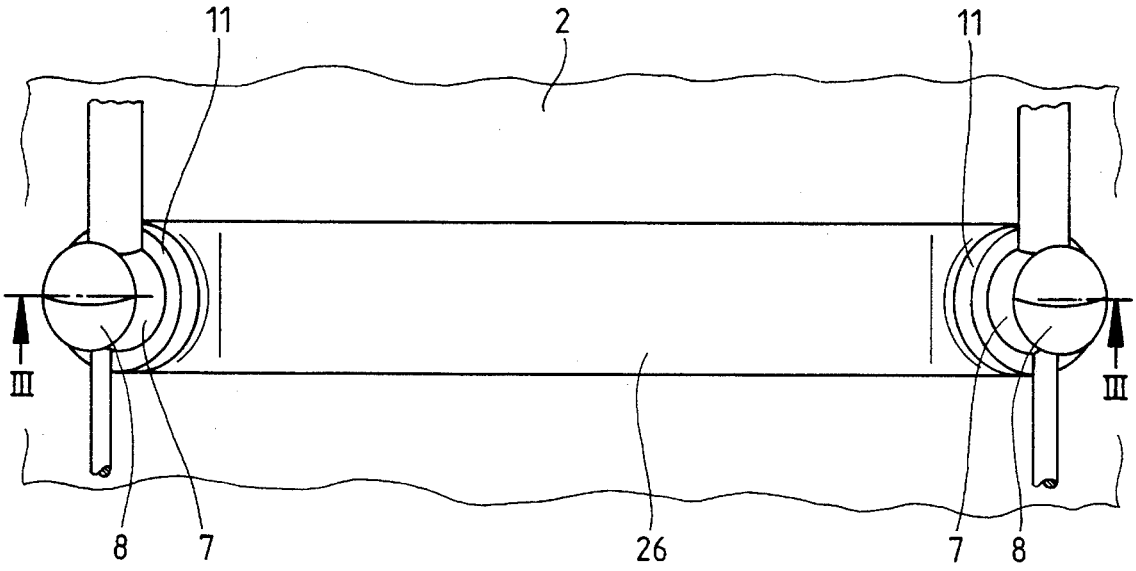
FIG. 2 is a front view, on an enlarged scale, showing a holding stirrup fastened in a dampened manner in accordance with the present invention on the resonator shell of the membranophone.

FIG. 1 of the drawing shows a membranophone in the form of a bass drum 1. The bass drum 1 includes a resonator shell 2 and a principal or head skin 3 mounted across the upper opening of the resonator shell 2 and a secondary skin 4 mounted across the lower opening of the resonator shell 2. The skins 3 and 4 are tightened through winding hoops, not shown, by means of tightening hoops 5 which act on the winding hoops. The edge tension of the head skin 3 across the opening cross-section can be changed by means of the tightening hoop 5 and, thus, the tuning of the tom-tom drum or the bass drum 1 can be influenced. In the same manner, the edge tension of the secondary skin 4 can be varied through the tightening hoop 5, so that the skin 4 can also be tuned in a suitable manner.

Figure 3:
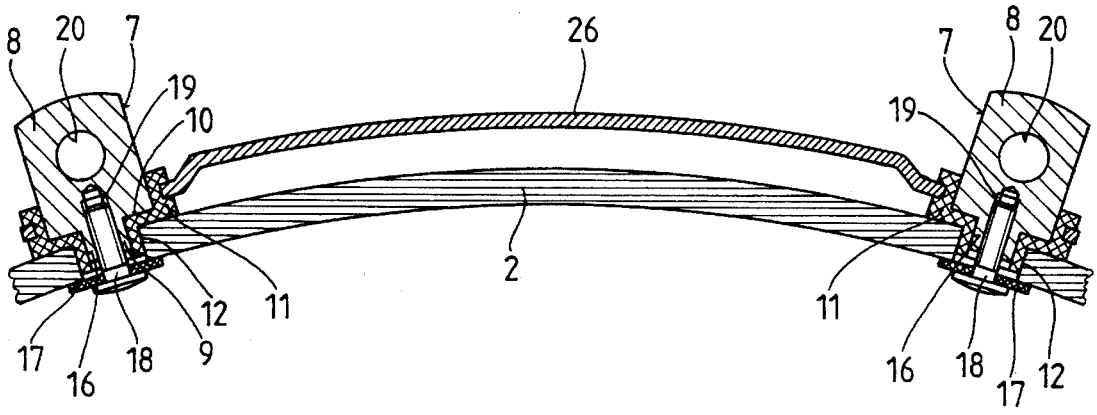
FIG. 3 is a sectional view of the holding stirrup taken along line III—III of FIG. 2.

For changing the tension of the skins, the tensioning hoops 5 interact with tensioning devices 6 which include threaded members, wherein the tensioning devices 6 are arranged uniformly spaced over the outer circumference of the resonator shell 2. Each tensioning device 6, i.e., the tensioning device for the head skin 3 as well as the tensioning device for the secondary skin 4, has support members 7 anchored on the resonator shell 2. The support member 7 project radially outwardly and preferably include a head member which is circular in cross section. Each support member 7 has a head piece 8 with a relatively large diameter and a neck 9 having a reduced diameter, wherein the neck 9 is connected rearwardly to the head piece 8 so as to form a rear surface 10, as shown in FIG. 3.

Figure 7:
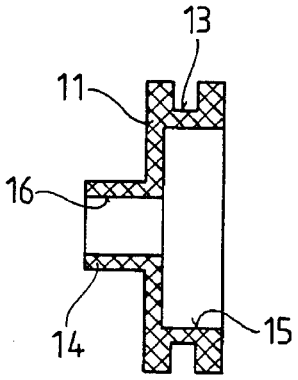
FIG. 7 is a cross-sectional view of a disk-like damping member according to the present invention.

The support members 7 engage with the neck 9 in corresponding bores of the resonator shell 2, wherein an elastic damping member 11, for example, of rubber, is arranged between the neck 9 and the bore 12. The damping member 11 is disk-shaped as can be seen in FIG. 7. The damping member 11 has a circumferential groove 13 and has on one side a central pin 14 and on the other side a recess 15 adapted to the contour or the diameter of a support member 7. A through bore 16 extends through the pin 14 to the recess 15.

In the mounted state, the damping members 11 engage with the pins 14 and the bores 12 of the resonator shell 2 and the support members 7 are inserted into the recesses 15 of the damping members 11 in such a way that they rest flush with the rear surfaces 10 against the bottom of the recess 15 and engage with the necks 9 in the through bores 16. For fastening the support members 7 to the resonator shell 2, screws 18 are passed through the rubber disk 17 and the damping member 11 from the inner circumference of the resonator shell 2, wherein a flat rubber disk 17 is arranged between the resonator shell 2 and the screw 18. The screws 18 interact with an internal thread 19 which is provided coaxially in the neck 9 and in the head piece 8 of each support member 7. The support member 7 is securely fastened to the resonator shell 2 in an elastically resilient manner because of the damping member 11 arranged between the resonator shell 2 and the screw 18.

Figure 4:
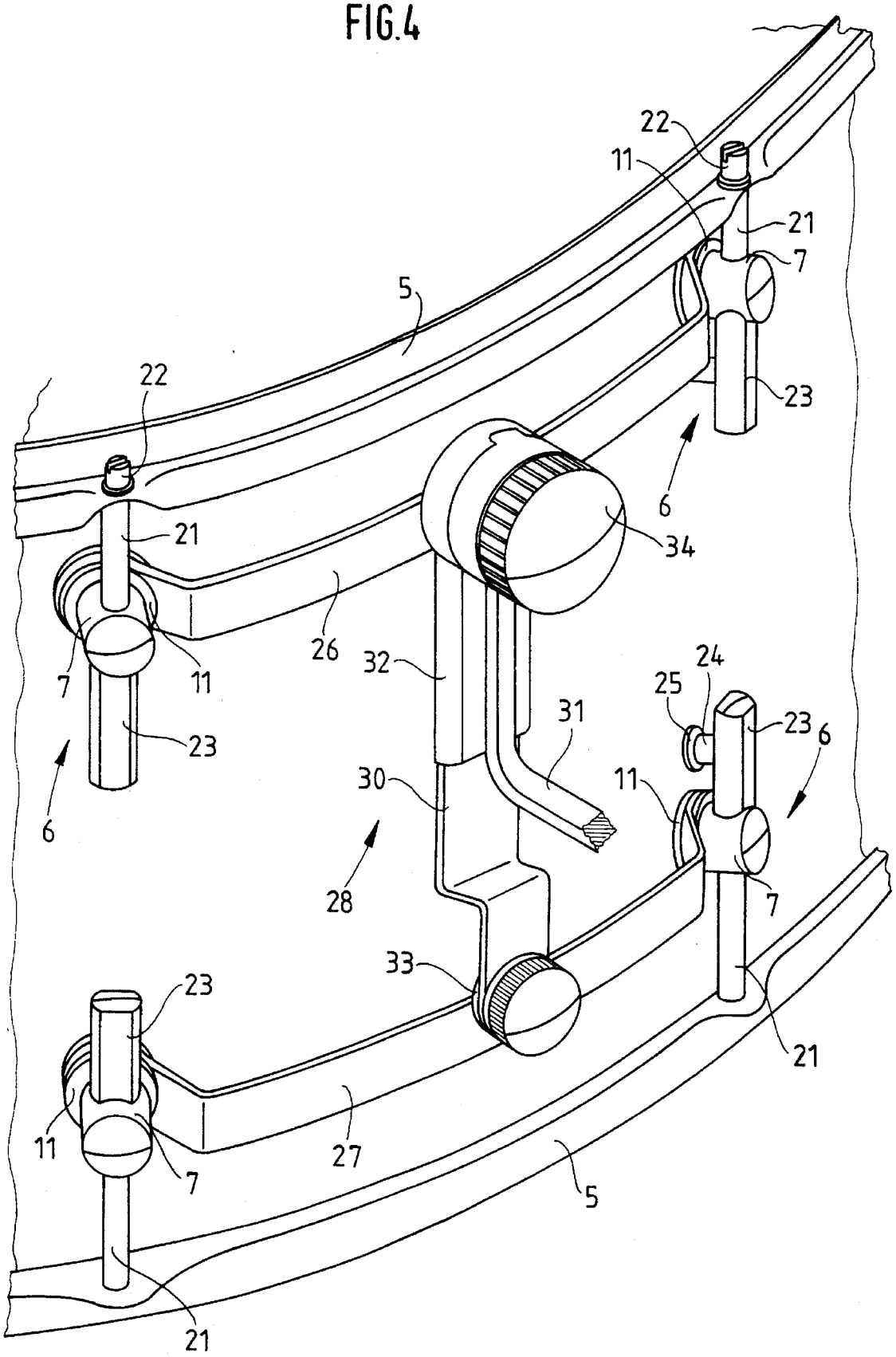
FIG. 4 is a front view showing as a detail a support device dampened in accordance with the present invention composed of two holding stirrups arranged one above the other and connected to each other through a telescoping lug.

In diametral direction, the head piece 8 of each support member 7 has a transverse duct 20 which includes a sleeve 21 for a tightening screw or threaded member 22, wherein the sleeve 21 is arranged at the tightening hoop 5 of the head skin 3 or the tightening hoop 5 of the secondary skin 4, and wherein the threaded portion of the tightening screw or threaded member 22 may extend up to a counterpiece 23 which is placed from the other side against the support member 7, as shown in FIG. 4. The sleeve 21 and counterpiece 23 form a rod shaped tightening element. The counterpieces 23 are supported through transverse struts 24 on the resonator shell 2, i.e., the ends of the counterpieces 23 are fastened through elastic damping members 25 on the resonator shell 2. The damping member 25 can be constructed similar to the damping member 11 as a disk. By tightening or loosening the tightening screws 22, the head skin 3 and/or secondary skin 4 can be tuned.

Figure 5:
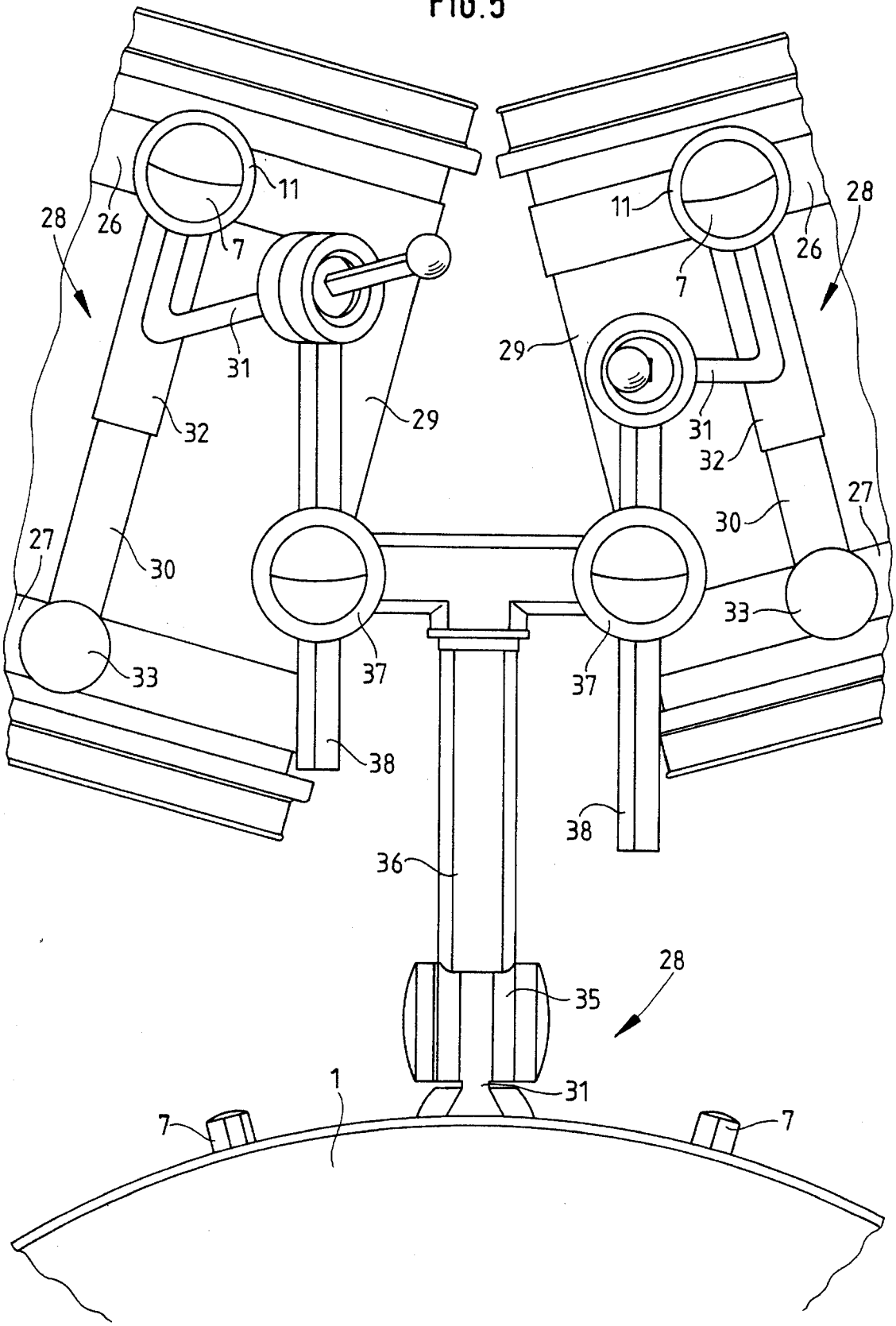
FIG. 5 is a schematic view of tom-tom drums supported by a support device of a bass drum according to the present invention.

As shown in FIGS. 1 and 4, holding stirrups 26, 27 of a support device 28 for tom-tom drums 29 shown in FIG. 5 to be mounted on the bass drum 1 are fastened to the resonator shell 2 in a dampened manner by means of damping elements 11 receiving the support members 7. For this purpose, the holding stirrups 26, 27 have eye-like ends, so that the damping members 11 can be inserted in the annular openings and can be clipped with the circumferential groove 13 onto the holding stirrup. Thus, the holding stirrups 26, 27 are neither in direct contact with the resonator shell 2 nor with the support member 7. The two holding stirrups 26, 27 arranged at a distance from each other and one above the other are connected to each other through a lug 30, as shown in FIG. 1. The lug 30 has a fastening member 31 which makes it possible to fasten to the bass drum 1 two tom-tom drums 29 which are also provided with a dampened support device 28 each, as illustrated in FIG. 5.

In the configuration of the support device 28 shown in FIG. 4, the lug 30 is of telescoping configuration. It has a displaceable guide shoe 32 which makes it possible to change the mounting height of each tom-tom drum 29 or to adjust the support device 28 to different heights of the membranophone, so that the same support device can be used in a variable manner, i.e., it can be used for other membranophones if necessary. At least the end of the lug 30 corresponding to the lower holding stirrup 27 is supported with a damping member 33 similar to the damping member 11 and, thus, is mounted in a dampened manner on the holding stirrup 27. In the configuration of FIG. 4, the guide shoe 32 which supports the fastening member 31 is mounted on the lug 30 so as to be releasable from the rear side, not shown, through a clamping grip 34 or a separate screw.

Figure 6:
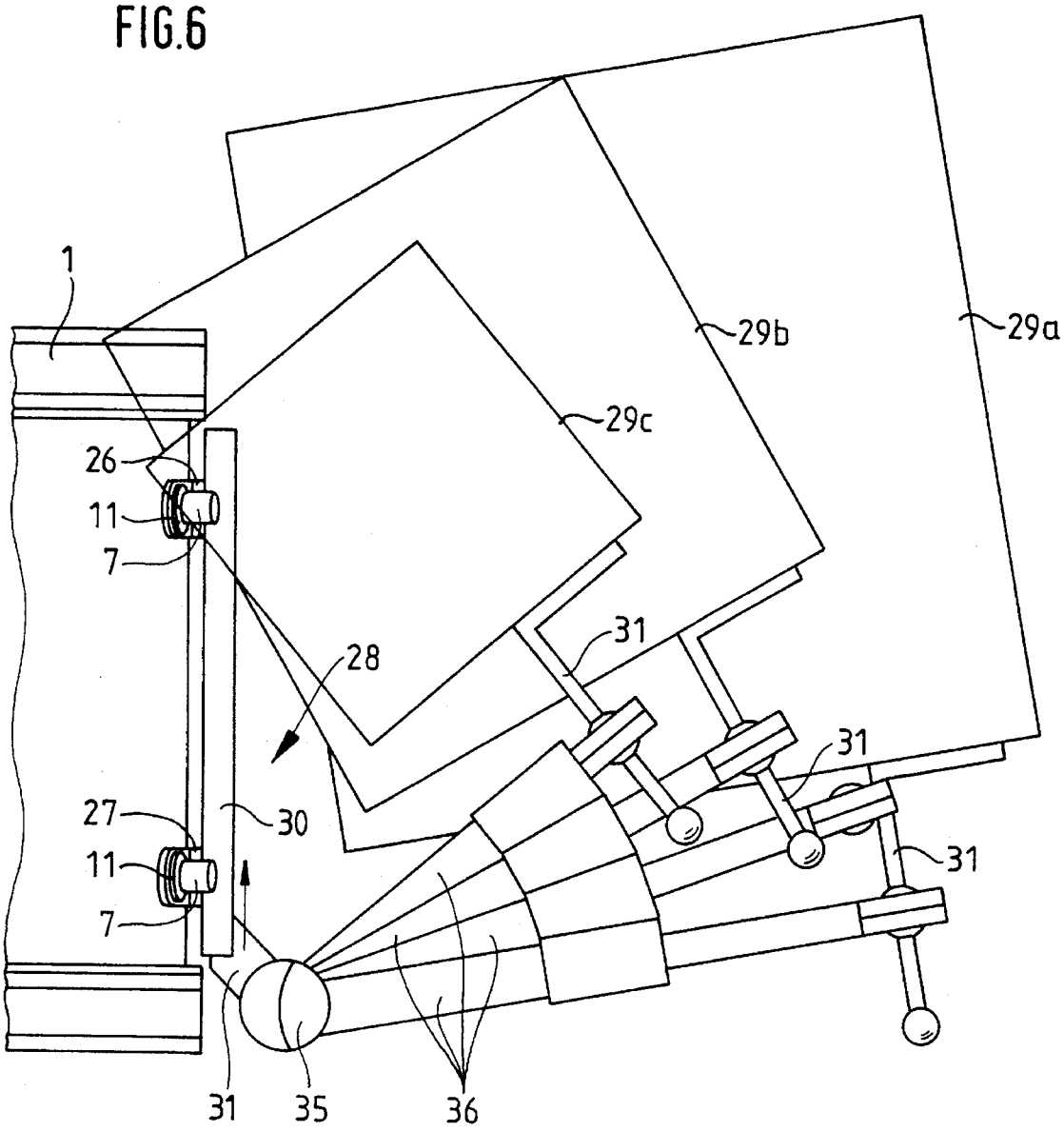
FIG. 6 is a schematic view of a tom-tom drum mounted by means of a rotary joint on a bass drum with a support device arranged dampened in accordance with the present invention, wherein the tom-tom drum is shown in three different sizes and in three different positions of inclination.

As illustrated in FIGS. 5 and 6, the free end of the fastening member 31 of the support device 28 mounted on the bass drum 1 is provided with a clamping piece 35 constructed as a rotary joint which makes it possible to receive a two-arm support member 36 whose ends of the arms have clamping heads 37 which, in turn, engage in adjusting rods 38 inserted in the fastening members 31 of the two tom-tom drums 29. As is evident from FIG. 6, the rotatable clamping piece 35 makes it possible to vary the position of inclination of a tom-tom drum 29 fastened to the support device 28 of the bass drum 1, independently of the size and the desired playing position of the respective tom-tom drum. In order to simplify the illustration, FIG. 6 shows the positions of inclination of three differently sized tom-tom drums 29*a*, 29*b* and 29*c*.

The invention is not limited by the embodiments described above which are presented as examples only but can be modified in various ways within the scope of protection defined by the appended patent claims.

We claim:

1. A membranophone comprising a resonator shell having an outer circumference and opening rims, a principal skin and a secondary skin at the opening rims, a skin tightening and tuning device, the skin tightening and tuning device including rod-shaped tightening elements at least for the principal skin, the tightening elements being arranged uniformly distributed over the outer circumference of the resonator shell, further comprising support members fastened to the resonator shell for supporting the tightening elements, threaded members being engaged with said tightening elements and being mounted between the tightening elements and at least the principal skin, so that the skin is adjustably tightenable relative to the opening rim of the resonator shell, further comprising at least one holding stirrup mounted on the resonator shell, damping members being arranged between the support members and the resonator shell, the holding stirrup being mounted on the damping members.

2. The membranophone according to claim 1, wherein the holding stirrup has two ends, a damping member each being clipped onto the ends.

3. The membranophone according to claim 2, wherein the damping members are mounted on the support members.

4. The membranophone according to claim 3, comprising two holding stirrups arranged spaced apart from each other in axial direction of the membranophone.

5. The membranophone according to claim 4, comprising a lug connecting the two holding stirrups.

6. The membranophone according to claim 5, wherein the lug comprises an axially adjustable fastening element.

7. The membranophone according to claim 6, wherein the lug is a telescoping lug.

8. The membranophone according to claim 6, comprising a guide shoe displacably mounted on the lug together with the fastening element.

9. The membranophone according to claim 5, comprising another damping element mounted between the lug and the holding stirrup at the secondary skin.

10. The membranophone according to claim 6, wherein the fastening element comprises a clamping member in the form of a rotary joint.

11. A damping member for a membranophone, the membranophone including a resonator shell having an outer circumference and opening rims, a principal skin and a secondary skin at the opening rims, a skin tightening and tuning device, the skin tightening and tuning device including rod-shaped tightening elements at least for the principal skin, the tightening elements being arranged uniformly distributed over the outer circumference of the resonator shell, further including support members fastened to the resonator shell for supporting the tightening elements, threaded members being engaged with said tightening elements and being mounted between the tightening elements and at least the principal skin, so that the skin is adjustably tightenable relative to the opening rim of the resonator shell, further comprising at least one holding stirrup mounted on the resonator shell, the damping member being arranged between the support members and the resonator shell, the damping member comprising a disk with a central pin, the disk having a circumferential groove, the disk and the central pin defining a through bore.

12. The damping member according to claim 11, the disk having a surface facing away from the pin, the surface facing away from the pin having a recess.

13. The damping member according to claim 11, wherein the damping member is of a soft, elastic material.

14. The damping member according to claim 13, wherein the damping member is of rubber.

* * * * *